US007347261B2

(12) United States Patent
Markel et al.

(10) Patent No.: US 7,347,261 B2
(45) Date of Patent: Mar. 25, 2008

(54) MAGNETIC LOCATOR SYSTEMS AND METHODS OF USE AT A WELL SITE

(75) Inventors: Daniel C. Markel, Pearland, TX (US); Rodger Anderson, Friendswood, TX (US); Richard I. Luht, III, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 237 days.

(21) Appl. No.: 11/162,372

(22) Filed: Sep. 8, 2005

(65) Prior Publication Data

US 2007/0051512 A1 Mar. 8, 2007

(51) Int. Cl.
*E21B 47/09* (2006.01)

(52) U.S. Cl. ..... 166/255.1; 166/66.5

(58) Field of Classification Search ..... 166/255.1, 166/255.2, 66.5
See application file for complete search history.

(56) References Cited

U.S. PATENT DOCUMENTS 4,940,095 A 7/1990 Newman
4,964,462 A 10/1990 Smith
5,014,781 A * 5/1991 Smith ..... 166/66.5
6,655,462 B1 * 12/2003 Carmichael et al. ..... 166/311
6,720,764 B2 4/2004 Relton et al.
6,768,299 B2 7/2004 Almaguer
2003/0052670 A1 3/2003 Miszewski
2004/0099415 A1 * 5/2004 George ..... 166/255.1
2005/0055163 A1 3/2005 Hopper
2006/0000605 A1 * 1/2006 Jordan et al. ..... 166/255.1

* cited by examiner

*Primary Examiner*—William P Neuder
(74) *Attorney, Agent, or Firm*—Robert A. Van Someren; Kevin B. McGoff; Bryan P. Galloway

(57) ABSTRACT

Magnetic locator systems and methods of using same at a wellhead are described. The magnetic locator systems include a magnetic field generator on an oilfield tool component, such as a deployment bar, adapted to be moved through an oilfield pressure control component, such as a blow-out preventer, lubricator, riser pipe, or wellhead, and a magnetic field sensor located outside of the pressure control component adapted to detect the magnetic field and thus the position of the tool component in the pressure control component. The systems and methods of the invention provide safer and more efficient operation of oil and gas well pressure control systems. This abstract allows a searcher or other reader to quickly ascertain the subject matter of the disclosure. It will not be used to interpret or limit the scope or meaning of the claims. 37 CFR 1.72(b).

26 Claims, 5 Drawing Sheets

MAGNETIC LOCATOR SYSTEMS AND METHODS OF USE AT A WELL SITE

FIELD OF INVENTION

The present invention relates generally to the field of pressure containment of oil and gas wells, and more particularly to magnetic locator systems and their use in locating equipment being injected or withdrawn from high pressure oil and gas wells in the vicinity of the blow out preventer and/or associated equipment, such as a lubricator or riser.

RELATED ART

In downhole oilfield completions, it is necessary to use pressure equipment at the surface of an oil and/or gas well to contain the well pressure generated by the downhole formation. The main type of pressure equipment is called a blow-out preventer (BOP) which is a hermetically sealed, thick-walled, metal pipe with valves (for opening and closing pressure communication) and rams (for sealing around, holding stationary or shearing off any tool that is inside the BOP). To run oilfield tools into a pressurized well, the tools are placed inside a lubricator or riser (another hermetically sealed, thick-walled, metal pipe) and the lubricator is then attached and sealed to the top of the BOP. The lubricator is used as a pressure equalization chamber for the tools. The bottom end of the lubricator has a seal and mechanical connection for attaching to the BOP. The top end of the lubricator has a sealed (perhaps packed off) bore for allowing wireline (or slickline) cable or coiled tubing to be conveyed through the lubricator and down the hole with no pressure leakage to the external atmosphere.

When deploying downhole tools into a well, a section of the tools string is placed inside the lubricator at ambient pressure and mechanically connected to the method of conveyance (electric line cable, slickline cable, or tubing) and then the lubricator assembly is then attached to the top of the BOP. A ram is opened on the BOP (and a valve on the wellhead) and the tools are lowered downhole. This process is then repeated until the entire assembly has been deployed into the well. When coming out of the well, the operation is performed in reverse as long as the tool assembly is above the wellhead valve. If the toolstring is longer than the lubricator the wellhead valve may have to remain open while the ram on the BOP is closed, effectively sealing the wellbore pressure below the BOP's. The tools, which can be subjected to formation pressure, are conveyed up through the BOP and into the lubricator when the tool, or applicable section thereof, clears a specific point (pipe/slip rams) on the BOP, a ram inside the BOP is closed and the pressure inside the lubricator is bled off until it reaches ambient pressure.

The length of the lubricator dictates the length of the tools or tool section that can be run down hole. If longer tool assemblies are required downhole, a device known as a deployment bar can be used as a means of running multiple sections of tools which are much longer than the internal length inside the lubricator. The function of the deployment bar is to seal and retain the top end of a tool assembly inside the BOP when the tool assembly is being lowered or being retrieved from a pressurized well. The deployment bar also serves as a sacrificial joint to shear in order to close a control valve in the BOP system effectively shutting the wellbore, in the event of failure of the pressure control system that may allow wellbore fluid to escape to the atmosphere. This will also allow for another or several tool assemblies to be connected to or disconnected from the assembly in the BOP with the use of a lubricator.

The deployment bar has a limited length of sealing surface, typically 5 to 7 feet (1.5 to 2.1 meters) long. Due to the safety and service aspects of the operation, it is absolutely essential that the deployment bars be placed in the proper location inside the BOP when the sealing rams are forced against them. This layout of the BOP system will dictate the exact length required for the deployment bars. Failure to locate them correctly inside the BOP may result in serious or even fatal safety incidents, severe tool damage and costly operational expenses. Since deployment bars are inside a thick-wall pipe and not visible to personnel at the well site, it would be desirous to provide a detector and detection method to locate them inside the surface equipment.

Thus, there is a continuing need for magnetic locator elements and methods that address one or more of the problems that are set forth above.

SUMMARY

In accordance with the present invention, magnetic locator systems and methods of use are described that reduce or overcome problems in previously known magnetic locator systems and methods.

A first aspect of the invention are magnetic locator systems useable at a well site, comprising:

an oilfield tool component comprising a magnetic field generator, the oilfield tool component adapted to be moved through one or more oilfield pressure control components; and a magnetic field sensor adapted to detect the magnetic field and allow an operator to determine position of the oilfield tool component in one or more of the oilfield pressure control components.

Systems of the invention include those wherein the magnetic field generator is attached to one or more oilfield tool components. The term "oilfield tool component" includes oilfield tools, tool strings, deployment bars, coiled tubing, jointed tubing, wireline sections, slickline sections, combinations thereof, and the like adapted to be run through one or more oilfield pressure control components. The term "oilfield pressure control component" may include a BOP, a lubricator, a riser pipe, a wellhead, or combinations thereof. The magnetic sensor may be any sensor or plurality of sensors able to detect the magnetic field from the magnetic field generator, including magnetometers, Hall effect sensors, magneto resistors, magneto diodes, and combination thereof. Systems of the invention include those where the oilfield tool component comprises one or more deployment bars, such as embodiments including an upper deployment bar and a lower deployment bar, with each deployment bar having a magnetic field generator thereon. The magnetic field generator may be attached to the oilfield tool component, for example by clamping, bolting, welding, winding around, and the like, or built into the oilfield tool component therewith).

Another aspect of the invention are methods of using the inventive magnetic locator systems, one method of the invention comprising:

moving an oilfield tool component through one or more oilfield pressure control components, the oilfield tool component comprising a magnetic field generator; and sensing the magnetic field generated by the magnetic field generator, thus informing an operator of position of the oilfield tool component in one or more of the pressure control components.

Methods of the invention include those comprising wherein the magnetic field generator provides a magnetic field strong enough to be detected by the sensor. Other methods of the invention are those including using a mechanical instrument, such as a magnetometer, compass, or an electronic device to sense the magnetic field. Other methods include displaying the sensed magnetic field on a display device, such as a computer, CRT, or some other analog or digital readout device. Certain embodiments of the methods of using the inventive magnetic locator system may include connecting a magnetic field sensor to a wireline depth control measurement apparatus used by a wireline service company, and optionally have any signal input read real-time or near real-time with the depth location readout. Other methods include using magnets selected from passive magnets, active magnets, and combinations thereof. For example, several magnets may be positioned in close proximity on a particular oilfield tool component to generate a unique magnetic code for that portion of the tool component, identifying not only position of but the identity of the oilfield tool component hidden from view by the pressure control components.

Systems and methods of the invention will become more apparent upon review of the brief description of the drawings, the detailed description of the invention, and the claims that follow.

BRIEF DESCRIPTION OF THE DRAWINGS

The manner in which the objectives of the invention and other desirable characteristics can be obtained is explained in the following description and attached drawings in which.

Figure 1:
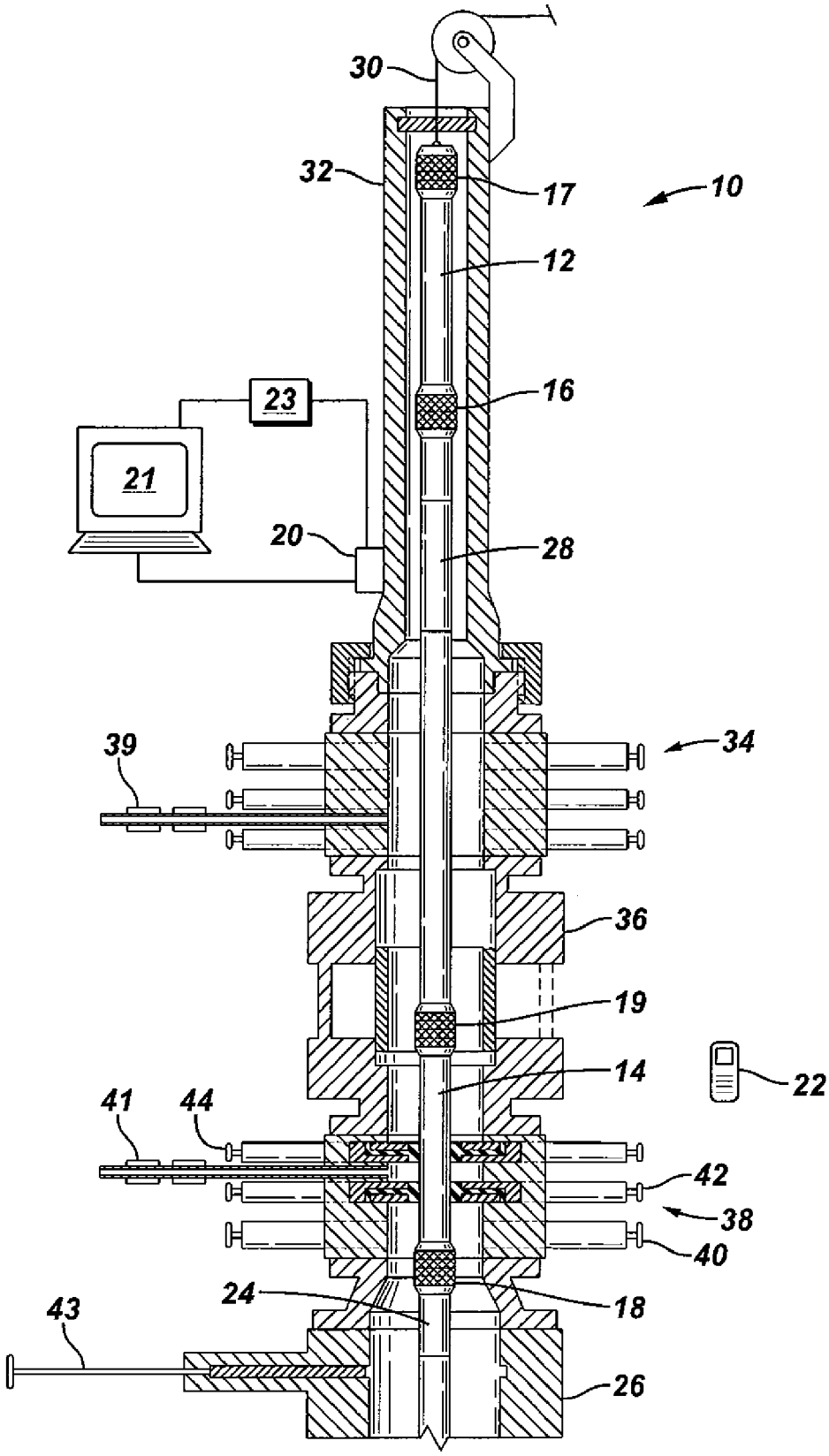
FIG. 1. is a schematic partial cross-sectional view of a first system embodiment of the invention having a two deployment bars, associated magnetic field generators, and magnetic field sensors.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romanic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

The invention describes magnetic locator systems and methods of using same to increase safety and operational efficiency of oilfield pressure control components. Currently, while operation of oilfield pressure control components, such as BOPs, lubricators, riser pipes, and wellheads, is generally made safe through frequent testing, there remains room for improvement. One problem is the inability to known exactly where in the BOP, lubricator, riser pipe and/or wellhead an oilfield tool component is. For example, for exploratory or "wildcat" wells, where formation geography and pressure is not well known, ideally it would be best to know where each oilfield tool component is when moving through the pressure control components in order to be able to close rams down on oilfield tool components effectively. Without knowing locations of deployment bars, for example, it could be difficult to locate the deployment bar seal surfaces for a BOP ram to close down and seal a well. Thus, there is a continuing need for systems and methods that address one or more of these problems.

Given that safety is a primary concern, and that there is considerable investment in existing equipment, it would be an advance in the art if existing oilfield tool components, such as deployment bars, oilfield tools, tool strings, coiled tubing, jointed tubing, and the like, and existing oilfield pressure control components, such as BOPs, lubricators, riser pipes, and wellheads, could be modified and/or improved to increase safety and efficiency during an oil or gas field operation, with minimal interruption of production, completion and other well operations. This invention offers systems and methods for these purposes.

As used herein, the terms "BOP" and "blow-out preventer" are used generally to include any system of valves at the top of a well that may be closed if an operating crew loses control of formation fluids. The term includes annular blow-out preventers, ram blow-out preventers, shear rams, and BOP stacks. By closing this valve or system of valves (usually operated remotely via hydraulic actuators), the crew usually regains control of the reservoir, and procedures can then be initiated to increase the mud density until it is possible to open the BOP and retain pressure control of the formation. BOPs come in a variety of styles, sizes and pressure ratings. Some can effectively close over an open wellbore, some are designed to seal around tubular components in the well (drillpipe, casing or tubing) and others are fitted with hardened steel shearing surfaces that can actually cut through drillpipe. Since BOPs are critically important to the safety of the crew, the rig and the wellbore itself, BOPs are inspected, tested and refurbished at regular intervals determined by a combination of risk assessment, local practice, well type and legal requirements. BOP tests vary from daily function testing on critical wells to monthly or less frequent testing on wells thought to have low probability of well control problems.

In annular BOPs, the sealing element resembles a large rubber doughnut that is mechanically squeezed inward to seal on either pipe (drill collars, drillpipe, casing, or tubing) or the open hole. The ability to seal on a variety of pipe sizes is one advantage the annular blowout preventer has over ram-type blowout preventers. Most BOP stacks contain at least one annular BOP at the top of the BOP stack, and one or more ram-type preventers below. While not considered as reliable in sealing over the open hole as around tubulars, the elastomeric sealing doughnut is currently required by American Petroleum Institute specifications to seal adequately over the open hole as part of its certification process.

Ram BOPs are devices that can be used to quickly seal the top of the well in the event of a well control event (kick). A ram BOP consists of two halves of a cover for the well that are split down the middle. Large-diameter hydraulic cylinders, normally retracted, force the two halves of the cover together in the middle to seal the wellbore. These covers are constructed of steel for strength and may be fitted with elastomer components on the sealing surfaces. The halves of the covers, formally called ram blocks, are available in a variety of configurations. In some designs, they are flat at the mating surfaces to enable them to seal over an open wellbore. Other designs have a circular cutout in the middle that corresponds to the diameter of the pipe in the hole to seal the well when pipe is in the hole. These pipe rams effectively seal a limited range of pipe diameters. Variable-bore rams are designed to seal a wider range of pipe diameters, albeit at a sacrifice of other design criteria, notably element life and hang-off weight. Still other ram blocks are fitted with a tool steel-cutting surface to enable the ram BOPs to completely shear through drillpipe, hang the drillstring off on the ram blocks themselves and seal the wellbore. Obviously, such an action limits future options and is employed only as a last resort to regain pressure control of the wellbore. The various ram blocks can be changed in the ram preventers, enabling the well team to optimize BOP configuration for the particular hole section or operation in progress. Once the drillpipe is cut (or sheared) by the shear rams, it is usually left hanging in the BOP stack, and kill operations become more difficult. The joint of drillpipe is destroyed in the process, but the rest of the drillstring is unharmed by the operation of shear rams.

A blind ram is a thick, heavy steel component of a conventional ram blowout preventer. In a normal pipe ram, the two blocks of steel that meet in the center of the wellbore to seal the well have a hole (one-half of the hole on each piece) through which the pipe fits. The blind ram has no space for pipe and is instead blanked off in order to be able to close over a well that does not contain a drillstring. It may be loosely thought of as the sliding gate on a gate valve.

A BOP stack is a set of two or more BOPs used to ensure pressure control of a well. A typical stack might consist of one to six ram-type preventers and, optionally, one or two annular-type preventers. A typical stack configuration has the ram preventers on the bottom and the annular preventers at the top. The configuration of the stack preventers is optimized to provide maximum pressure integrity, safety and flexibility in the event of a well control incident. For example, in a multiple ram configuration, one set of rams might be fitted to close on 5-in. diameter drillpipe, another set configured for 4½-in. drillpipe, a third fitted with blind rams to close on the open hole and a fourth fitted with a shear ram that can cut and hang-off the drillpipe as a last resort. It is common to have an annular BOP or two on the top of the stack since annular BOPs can be closed over a wide range of tubular sizes and the open hole, but are typically not rated for pressures as high as ram preventers. The BOP stack may also include various spools, adapters and piping outlets to permit the circulation of wellbore fluids under pressure in the event of a well control incident.

A "lubricator", sometimes referred to as a lubricator tube or cylinder, provides a method and apparatus whereby oilfield tools of virtually any length may be used in a coiled or jointed tubing operation. In some embodiments use of a lubricator allows the coiled tubing injector drive mechanism to be mounted directly on the wellhead. An oilfield tool of any length may be mounted within a closed-end, cylindrical lubricator which is then mounted on the BOP. Upon establishment of fluid communication between the injector and the BOP and wellhead by opening of at least one valve, the oilfield tool is lowered from the lubricator into the wellbore with a portion of the tool remaining within the wellhead adjacent first seal rams located in the BOP which are then closed to engage and seal around the tool. The lubricator may then be removed and the injector head positioned above the BOP and wellhead. The tubing string is extended to engage the captured tool and fluid and/or electrical communication is established between the tubing and the tool. The injector drive mechanism (already holding/attached to the tubing string) may then be connected to the BOP or wellhead and the first seal rams capturing the tool are released and fluid communication is established between the wellbore and the tubing injector drive head. The retrieval and removal of the oilfield tool components are effected by performing the above steps in reverse order.

Referring now to the figures, FIG. 1 illustrates schematically, and not to scale, a partial cross-sectional view of a first system embodiment 10 of the invention having an upper deployment bar 12 and a lower deployment bar 14, associated magnetic field generators 16, 17, 18 and 19, which in this embodiment comprise disc-like permanent magnets between joints of the tool strings and the deployment bars, and magnetic field sensors 20 and 22. Magnetic field sensor 20 is illustrated as incorporated in a wall of a lubricator 32, while magnetic sensor 22 is illustrated as a hand-held device. It will be understood that more than one magnetic field sensor may be incorporated into lubricator 32, and that this is only an exemplary embodiment. As lubricator 32 is a pressure control component, magnetic field sensor 20, in some embodiments, may be built in to lubricator 32 so that the wall thickness of the lubricator is not diminished, and therefore its pressure rating is not diminished. Similarly, more than two or only one magnetic field generator may be used on any oilfield tool component. A first stage tool string 24 is illustrated entering a wellhead 26, wherein in this case the tool string is moving down into the well (not shown). First stage tool string 24 is connected to lower deployment bar 14, which is in turn connected to a second stage tool string 28, which in turn connects to upper deployment bar 12. Upper deployment bar 12 is driven by a control cable 30.

Also illustrated in FIG. 1 is a BOP stack comprising an upper BOP 34, which is in turn connected to a spool 36, which is in turn connected to a lower BOP 38. Lower BOP 38 is connected to wellhead 26. Tool strings of any length are initially mounted within lubricator 32, which is purposely made long enough to contain the length of the tool and having one closed end through which control cable 30 is passed. The central bore of each of tool strings 24 and 28 typically include a valve and/or other pressure control device, such as an O-ring (not illustrated) which, in its closed position, blocks pressurized fluid communication within each tool string. In some embodiments, the valve may comprise a manually operated ball valve. In other embodiments, the valve may be automatically opened when connected with coiled tubing such as through a quick-connect coupling. The lower end of lubricator 32 includes mounting means for attaching the lubricator to the BOP stack. Prior to mounting of lubricator 32 on upper BOP 34, lower BOP 38 is sealed off by closing one ore more blind rams 40 of lower BOP 38. Lubricator 32 is then mounted on upper BOP 34 and fluid communication between the wellbore and the lubricator is established by opening blind rams 40.

Following mounting of lubricator 32 and opening blind rams 40, first stage tool string 24 is lowered, using control cable 30, into the wellbore to a point where at least a portion of first stage tool string 24 remains in the BOP stack. A pair of pipe slips 42 in the BOP stack which are sized to engage the outer surface of first stage tool string 24 are then closed to clamp tool string 24 in position. Pipe rams 44 in the BOP stack are also closed into sealing engagement against the outer surface of first stage tool string 24.

With the first stage tool string valve in the closed position, second stage tool string 28 and its associated upper deployment bar 12 may then be connected. A coiled tubing may then be connected to upper deployment bar 12. In some embodiments a tubing injector drive mechanism may then be moved into position axially above lubricator 32. The coiled tubing may be connected to upper deployment bar 12 and the first and second stage tool string valves are opened either manually or automatically depending on valve type to establish fluid communication from the wellbore through the tool strings to the coiled tubing. The coiled tubing injector drive mechanism may then be mounted on the upper BOP 34, the pipe rams 44 and pipe slips 42 released from first tool string 24 and normal coiled tubing running and retrieval operations can then be conducted. In removing the coiled tubing, tool strings and deployment bars from the well, the operation is effected in reverse order.

As may be appreciated by the description of embodiment 10 of FIG. 1, magnetic field generators 16, 17, 18 and 19 work in tandem with magnetic field sensors 20 and 22 to help a crew locate upper deployment bar 12 and lower deployment bar 14. In similar fashion, other magnetic field generators may be positioned on first stage tool string 24 and second stage tool string 28. Hand-held magnetic field sensor 22 may be used to detect any of the magnetic fields, and may be used as a redundant check on any magnetic field sensor (such as sensor 20) incorporated into a pressure control component. This greatly facilitates a crew being able to determine when to actuate hydraulic rams in the BOP stack, or an annular BOP, to control pressure of the formation since the crew will have a better idea where the sealing surfaces of the deployment bars are (i.e. the regions of the deployment bars between their ends). The crew will also have better control over fluid injection or withdrawal through various conduits 39, 41, and 43.

In some embodiments of the invention, the magnetic axis of the magnetic field generators 16, 17, 18 and 19 may be generally parallel to a longitudinal axis of lubricator 32 so that flux lines of the magnetic flux field extend between the poles of the magnetic field generators in a dipole pattern. In such embodiments, magnetic field sensor 20 may be located below the south pole of magnetic field generator 16, and a companion magnetic field sensor (not illustrated) may be located above the north pole of magnetic field generator 16, as an example. The companion magnetic field sensor may be incorporated into the oilfield tool component, or hand-held sensor 22 may be used.

As is well known in operation of magnetic field generators, such as permanent magnets and electromagnets, some of the magnetic flux lines emanating from a magnetic field generator will pass through a portion of nearby objects. For example, in FIG. 1, flux lines from magnetic field generators 16 and 17 will pass through a portion of a wall of lubricator 32, and flux lines from magnetic field generators 18 and 19 will pass though a portion of lower BOP 38, or whatever the pressure control component they are near, and as a result, the strength of the magnetic field may be controlled by features of the lubricator and BOP, as the magnetic field is a function of the effective permeability of the path through which the flux lines pass. In the case of a lubricator, the permeability will primarily be affected by the wall thickness of the lubricator, and as a result, the strength of the magnetic field that is detected by the magnetic filed sensor 20 is affected by the wall thickness of lubricator 32. By detecting the magnetic field, and optionally the variation in strength of the magnetic field, systems of the invention may determine where a particular oilfield tool component (upper deployment bar 12, for example) is in proximity to magnetic field sensor 20, and thus to pipe rams, pipe slips, shear rams, and the like in upper BOP 34.

Figure 3:
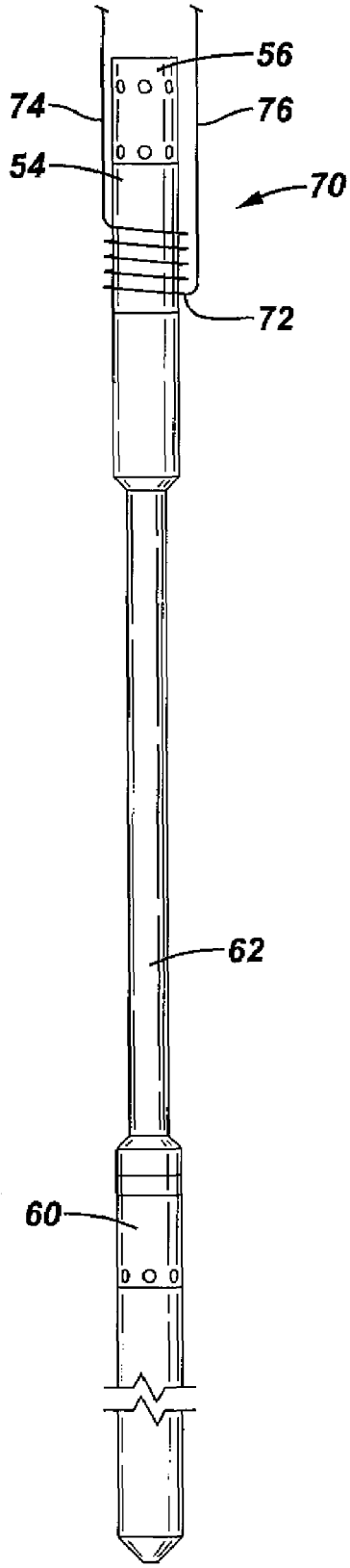
FIG. 3 is a schematic partial cross-sectional view of a second embodiment of an oilfield tool component comprising a magnetic field generator in accordance with the invention.

In some embodiments of the invention, the magnetic field generators may include a non-magnetic housing that protects and provides sealed containment of the magnetic filed generators, which may be advantageous when the magnetic field generators are electromagnets, as further explained in reference to FIG. 3. As an example, the housing may be connected to a wireline cable (see FIG. 3) that extends outside the pressure control components to provide power to an electromagnetic magnetic field generator.

In some embodiments of the invention, the magnetic field sensors may include or be connected with circuitry including one or more electronic filters, which may be peak detectors, for example, to detect the peaks of magnetic flux, or voltages indicative of magnetic flux, for purposes of filtering noise from the sensed fluxes or voltages indicative of the flux. Other filters (low pass and/or bandpass filters, as examples) may be used. The filters may provide signals to an indicator (sound or visual, for example, on a computer display screen or hand-held display screen) to indicate to the crew that an oilfield tool component is approaching a BOP ram, for example, or other feature of the pressure control components. When a particular pressure control component feature is approached, the crew may then move the oilfield tool component to a location where a good pressure seal may be maintained on the sealing surfaces.

Certain embodiments of the systems and methods of the invention may include connecting a magnetic field sensor to a wireline depth control measurement apparatus used by a wireline service company, and optionally have any signal input read real-time or near real-time with the depth location readout. This option is illustrated in FIG. 1 by a box 23, representing a wireline depth control measurement apparatus, and a computer terminal 21. Alternatively, only the magnetic field sensor 20 may send a signal or signals to computer terminal 21. Terminal 21 may be located on-site, remotely, or some combination thereof.

Figure 2:
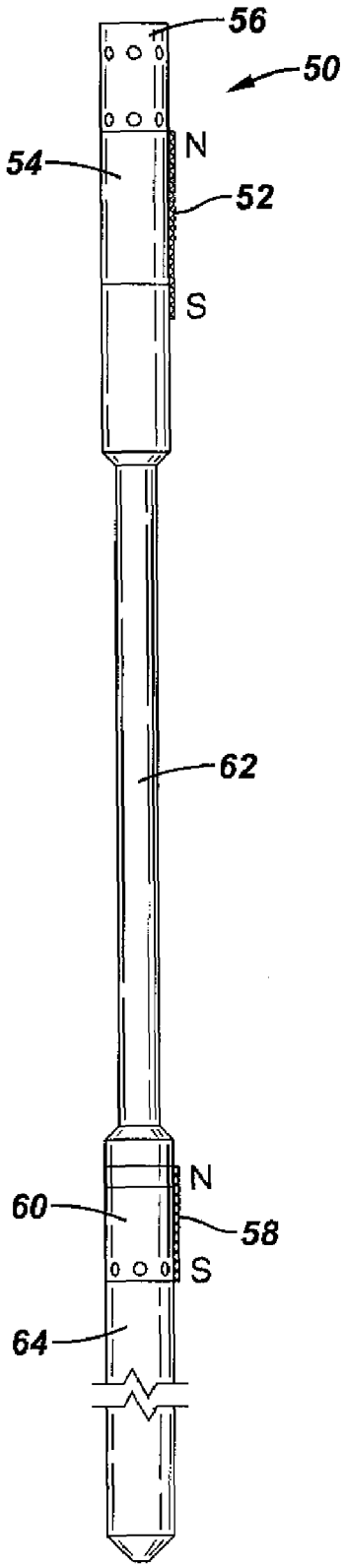
FIG. 2 is a schematic partial cross-sectional view of a first embodiment of an oilfield tool component comprising a magnetic field generator in accordance with the invention.

FIG. 2 is a schematic partial cross-sectional view of one embodiment 50 of an oilfield tool component comprising a magnetic field generator in accordance with the invention. In this embodiment, rather than disc magnets, a permanent bar magnet 52 may be welded or bolted to an upper portion 54 of deployment bar 56. Bar magnet 52 may have a north and a south pole, as indicated. Another permanent bar magnet 58 may be similarly attached to a lower end 60 of deployment bar 56, also having north and south poles as indicated. Deployment bar may have a necked-down region 62 for sealing engagement with rams of a BOP or other sealing device (not shown). Lower end 60 is illustrated connected to an oilfield tool component 64, such as an electric submersible pump, a packer, a valve, a bottom hole assembly, and the like, that is to be run into or removed from a wellbore.

FIG. 3 is a schematic partial cross-sectional view of another embodiment 70 of an oilfield tool component comprising a magnetic field generator in accordance with the invention. In this embodiment, rather than permanent disc magnets as in embodiment 10 of FIG. 1, or permanent bar magnets as in embodiment 50 of FIG. 2, embodiment 70 may include a temporary electromagnet comprised of a coil 72 and leads 74 and 76. In this embodiment it is of course important that upper portion 54 of deployment bar 56 comprise an iron core or some iron component so that when current flows in coil 72 the iron becomes a magnetic field generator. A second electromagnet may be provided on lower end 60 if desired, but only if an adequate seal may be made in sealing area 62, since a second coil would be required, along with leads that would have to pass necked-down region 62 where BOP rams would seal. A permanent magnet, such as magnet 58 in FIG. 2, may be a better solution. In embodiment 70 a controller may control the on/off operation of coil 72. In this manner, the controller may couple leads 74 and 76 to a signal source (an AC or DC source) via a switch to create the magnetic field. The size and the position of coil 72 relative to the pressure control components being passed through may be adjusted to achieve different results, such as sensitivity, position of necked-down region 62, and the like.

Figure 4:
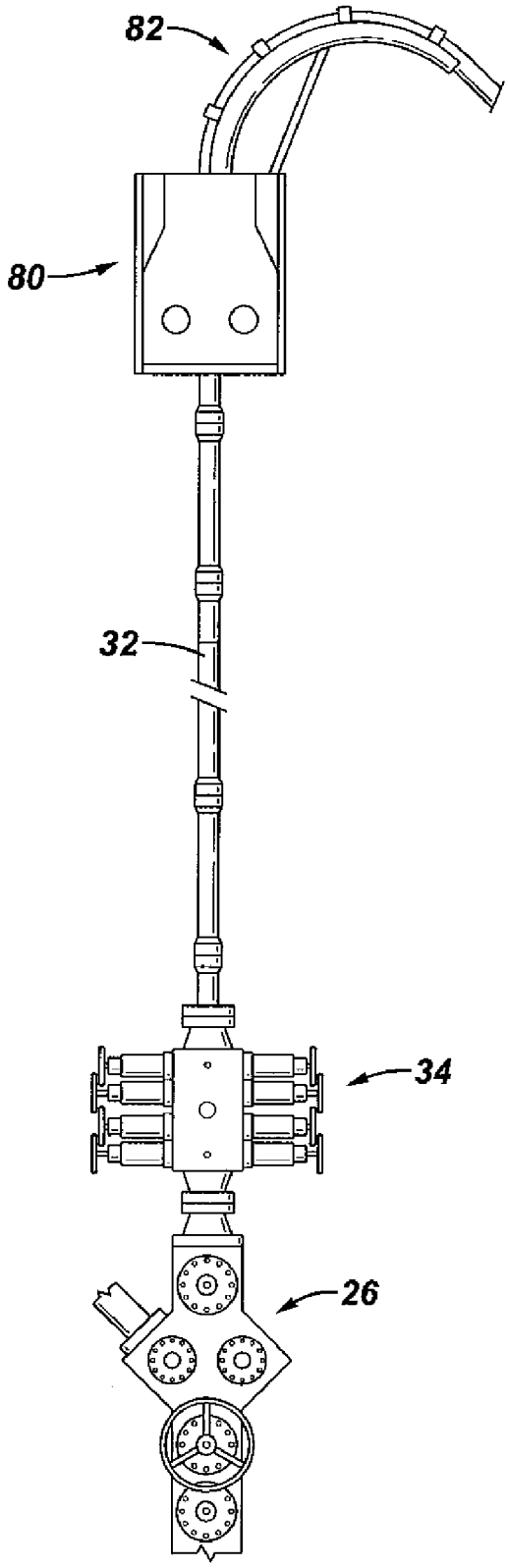
FIG. 4 (Prior Art)
FIG. 4 is a schematic side elevation view of a prior art system that may benefit from the system and method of the invention illustrated in FIG. 4A, which is a schematic partial a cross-sectional view of another system embodiment of the invention illustrating possible positions of magnetic field generators to generate a magnetic code.
Figure 4A:
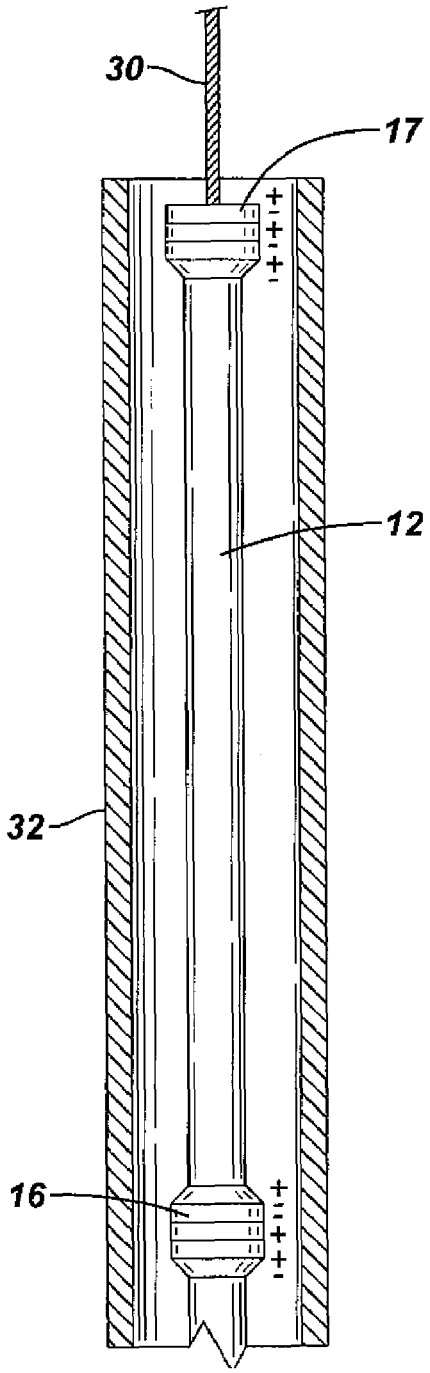

FIG. 4 is a schematic side elevation view of a prior art system that may benefit from the systems and methods of the invention, illustrating a lubricator 32, BOP 34, wellhead 26, coiled tubing injector 80, and coiled tubing gooseneck 82. FIG. 4A illustrates in partial cross-section a system embodiment of the invention illustrating possible positions of magnetic field generators to generate one or more magnetic codes that may be used in the prior art system of FIG. 4. Lubricator 32 is illustrated in cross-section, along with a deployment bar 12. Magnetic field generator 17 in this embodiment is illustrated as comprising three separate, disc-shaped permanent magnets, each disc magnet having its positive pole upward and its negative pole downward, so that the magnetic code produced and detected by a magnetic field sensor (not shown) would be "+,−,+,−,+,−." Each of the discs may be identical in terms of thickness and magnetic field generating capacity, but the invention is not so limited. The code could include different signal intensities produced by different strength magnets, for example. Permanent magnet 16 is also illustrated as comprising three disc-shaped permanent magnets, with the top-most and bottom-most discs having their positive poles upward and their negative poles downward, sandwiching a third permanent magnetic disc having its positive pole downward and its negative pole upward, so that its magnetic signature is "+,−,−, +,+,−." Many variations are possible, depending on the availability of permanent disc magnets, their magnetic field generating strength, and thickness of the pressure control components through which the magnetic field flux lines must pass, the magnetic permeability of the pressure control components, and the like.

Figure 5A:
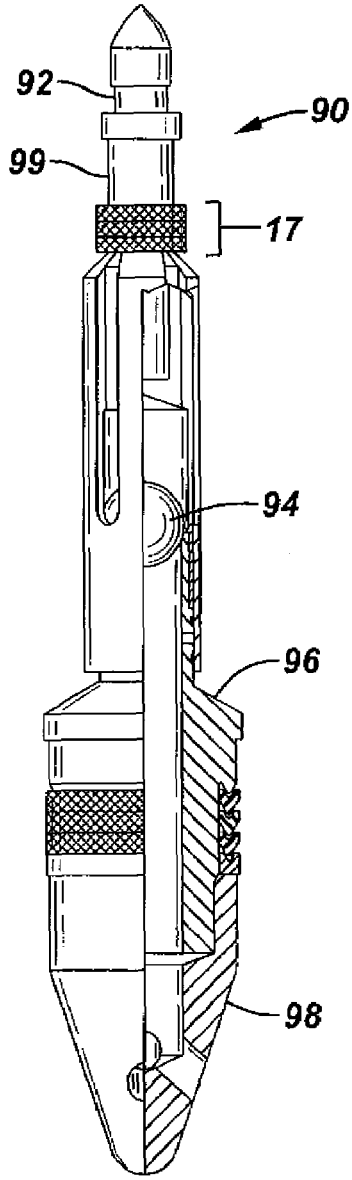
FIGS. 5A, 5B, and 5C are schematic side elevation views of three more embodiments of oilfield tool components comprising one or more magnetic field generators.
Figure 5B:
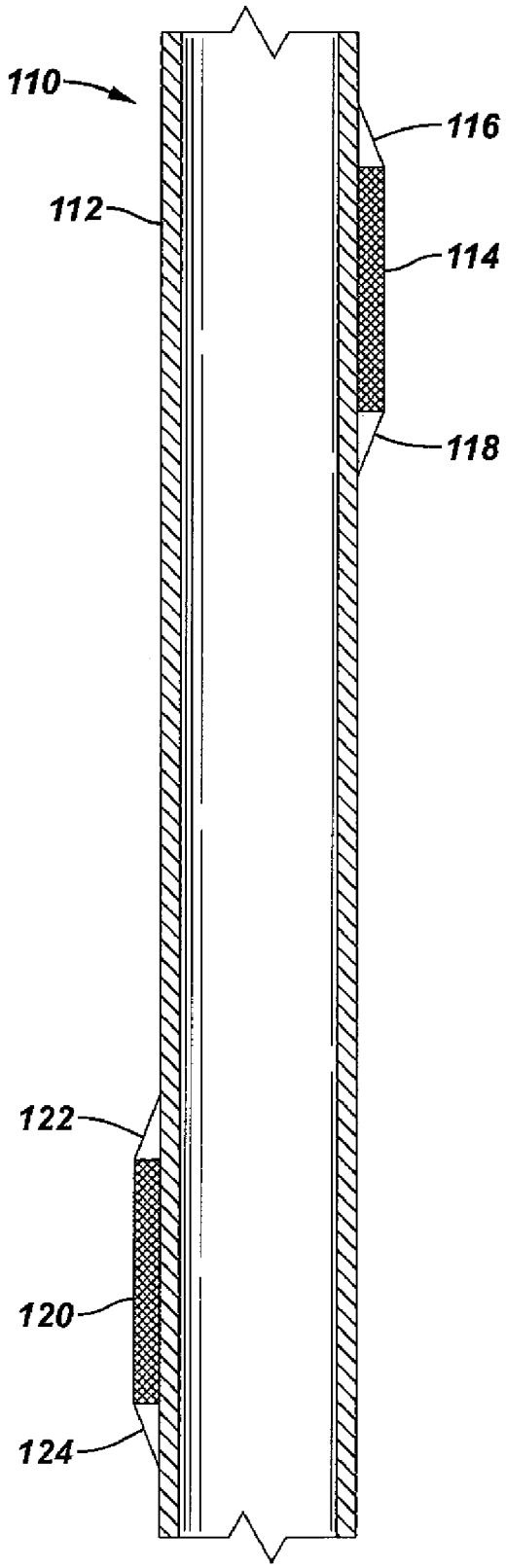
Figure 5C:
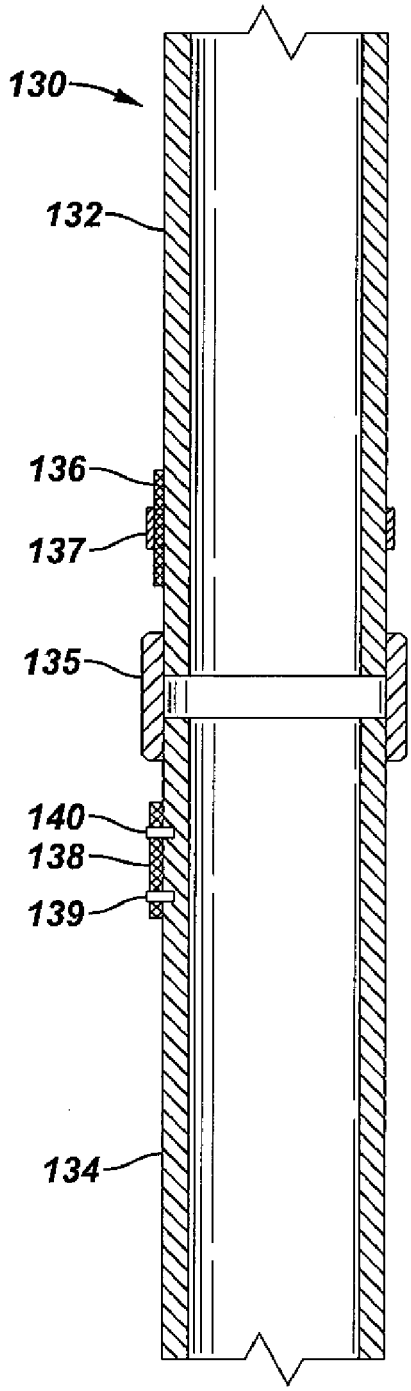

FIGS. 5A, 5B, and 5C are schematic side elevation views of three more embodiments of oilfield tool components comprising one or more magnetic field generators. FIG. 5A illustrates an oilfield tool component 90 known under the trade designation A-2 Equalizing Standing Valve, available from Schlumberger, modified in accordance with the invention to include three disc-shaped magnets 17 similar to the three magnets illustrated in FIG. 4A, which may be built in or attached to the equalizing standing valve upper body. These valves include a slickline-retrievable connection 92, a ball-and-seat-type check valve 94 with integral running 96 and pulling 98 necks, and are designed to hold pressure only from above. The equalizing standing valve 90 may be used in intermittent gas lift wells to contain fluid in the tubing string during an injection cycle. They may also be used to set packers and test a tubing string. An appropriate pulling tool and attached standing valve may be lowered into the tubing until the assembly shoulders against the packing bore of the nipple. The valve packing seals in the polished section. Downward jarring releases the pulling tool for retrieval to the surface. When removing the equalizing standing valve, upward jarring with the appropriate pulling tool equalizes and removes the assembly, and when the valve 90 approaches the well pressure control components at the surface, magnets 17 will allow one or more magnetic field sensors (not illustrated) to sense the location of the magnets, and lessen the risk that the valve will hit the inside top of the lubricator. This may reduce the risk that the valve will be disconnected and possibly drop back into the well bore.

FIGS. 5B and 5C illustrate two different oilfield tool components of the invention 110 and 130. FIG. 5B illustrates a coiled tubing section 112 modified in accordance with the present invention. Coiled tubing section 112 has welded thereon two bar magnets 114 and 120. As coiled tubing is frequently run in and out of cases wells, it may be advantageous to weld bar magnets 114 and 120 to coiled tubing 110 using fillet welds as shown at 116, 118, 122, and 124. This weld technique would provide a degree of slipperiness to the coiled tubing even in the presence of the magnets. FIG. 5C illustrates two sections of screwed pipe 132 and 134, held together by a screw collar 135. A first bar magnet 136 is illustrated clamped to pipe section 132 by a clamp 137, while a second bar magnet 138 is illustrated attached to pipe section 134 by a pair of bolts or screws 139 and 140. The advantages of having permanent magnets on coiled tubing and jointed pipe are apparent in view of the above discussion when these members must traverse through pressure control components.

Magnetic field sensors useful in the invention include magnetometers, which may include components that generate a signal indicative of the strength of the sensed magnetic field. As just a few examples, magnetic field sensors useful in the invention may be a Hall-effect sensor, a silicon-based sensor (e.g., an anisotropic magnetoresistive (AMR) sensor or a giant magnetoresistive (GMR) sensor), a superconducting quantum interference device (SQUID), a Search-Coil, a magnetic flux gate, or a magnetoinductive device. Hall effect sensors are well known in the art. Examples of available Hall effect sensors include those available from Honeywell and known under the trade designation SS 495A, and those available from Micronas under the trade designation HAL800.

To achieve as small a size for the magnetic field generators as possible, which might be advantageous for example on coiled tubing, the permanent magnets (if used) may be miniaturized and each may be formed from a material (SmCo-30, for example) that has a high magnetic strength. If an electromagnetic coil is used, the coil may have a winding that has a high number of turns, at least 1000 (40,000 for example). The winding may be formed on a bobbin that is formed of a highly permeable magnetic material (Carpenter electrical iron, for example). Systems of the invention may or may not have the miniature design features just described, depending on the particular embodiment of the invention.

An optional feature of magnetic locator systems of the invention is one or more additional sensors located on an oilfield tool component to detect the presence of hydrocarbons (or other chemicals of interest) in fluids traversing in or out of the oilfield pressure control components, such as coiled tubing in during a coiled tubing or jointed tubing operation. The chemical indicator may communicate its signal to a operator over a fiber optic line, wire line, wireless transmission, and the like. When a certain chemical is detected that would present a safety hazard in the pressure control component (such as oil or gas), the oilfield tool component may be moved or indexed to a safe position, or the well bore closed by a BOP ram, long before the chemical creates a problem.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. § 112, paragraph 6 unless "means for" is explicitly recited together with an associated function. "Means for" clauses are intended to cover the structures described herein as performing the recited function and not only structural equivalents, but also equivalent structures.

What is claimed is:

1. A magnetic locator system, comprising:

(a) an oilfield tool component comprising a magnetic field generator, the oilfield tool component being moved through one or more oilfield pressure control components; and (b) a magnetic field sensor detects the magnetic field and allow an operator to determine position of the oilfield tool component in one or more of the oilfield pressure control components the tool component moves through the one or more pressure control components.

2. The system of claim 1 wherein the oilfield tool component is selected from an oilfield tool, a tool string, a deployment bar, a coiled tubing section, a jointed tubing section, a wireline section, a slick-line section, and combinations thereof.

3. The system of claim 1 wherein the oilfield pressure control component is selected from a BOP, a lubricator, a riser pipe, a wellhead, and combinations thereof.

4. The system of claim 1 wherein the magnetic field generator is attached to the oilfield tool component.

5. The system of claim 4 wherein the magnetic field generator is attached to the oilfield tool component by a method selected from clamping, bolting, welding, winding around, and combinations thereof.

6. The system of claim 4 wherein the magnetic field generator is built in to the oilfield tool component.

7. The system of claim 1 wherein the magnetic field sensor is selected from a magnetometers, a Hall effect sensor, a magneto resistor, a magneto diode, a compass, an electronic device, and combinations thereof.

8. The system of claim 1 wherein the magnetic field sensor is incorporated into an apparatus separate from the oilfield pressure control components.

9. The system of claim 8 wherein the magnetic field sensor is incorporated into a hand-held device.

10. The system of claim 1 wherein the magnetic field sensor is incorporated into one or more of the oilfield pressure control components.

11. The system of claim 1 wherein the oilfield tool component comprises one or more deployment bars, with each deployment bar having a magnetic field generator thereon.

12. The system of claim 11, wherein the one or more deployment bars includes a magnetic source strong enough to be detected through the oilfield pressure control component by a magnetic field sensor.

13. A method comprising:

(a) moving an oilfield tool component through one or more oilfield pressure control components, the oilfield tool component comprising a magnetic field generator; and (b) sensing the magnetic field generated by the magnetic field generator with a magnetic field sensor, thus informing an operator of position of the oilfield tool component in one or more of the oilfield pressure control components.

14. The method of claim 13 comprising providing the magnetic field generator with a magnetic field strong enough to be detected by the magnetic field sensor located separate from the oilfield pressure control components.

15. The method of claim 14 wherein the magnetic field sensor is selected from magnetometers, Hall effect sensors, magneto diodes, magneto resistors, compasses, electronic devices, and combinations thereof.

16. The method of claim 13 comprising displaying the sensed magnetic field and/or position of the oilfield tool component on a display device.

17. The method of claim 14 comprising connecting the magnetic field sensor to a wireline depth location measurement apparatus.

18. The method of claim 17 comprising having the sensed magnetic field read in real-time or near real-time with the depth location.

19. The method of claim 13 wherein the magnetic field generator comprises one or more magnets selected from passive magnets, active magnets, and combinations thereof.

20. The method of claim 13 wherein two or more magnetic field generators are positioned in close proximity to generate a unique magnetic code, and the method comprises identifying position of the oilfield tool component in the oilfield pressure control component based on the code.

21. The method of claim 13 comprising attaching the magnetic field generator to one or more oilfield tool components selected from oilfield tools, tool strings, deployment bars, coiled tubing, jointed tubing, wireline sections, slick-line sections, and combinations thereof prior to moving the oilfield tool component through the oilfield pressure control component.

22. The method of claim 13 wherein the oilfield tool component is moved through an oilfield pressure control component is selected from a BOP, a lubricator, a riser pipe, a wellhead, and combinations thereof.

23. The method of claim 13 comprising attaching the magnetic field sensor to the oilfield pressure control component prior to moving the oilfield tool component through the oilfield pressure control component.

24. The method of claim 13 comprising moving an integral oilfield tool component and magnetic field generator through the oilfield pressure control components.

25. The method of claim 13 wherein the sensing of the magnetic field is performed by the magnetic field sensor incorporated into a hand-held device.

26. The method of claim 13 comprising attaching the magnetic field generator to the oilfield tool component, wherein the oilfield tool component comprises at least one deployment bar, each deployment bar having a dedicated magnetic field generator, the method comprising sensing separate magnetic fields indicating position of each deployment bar.

* * * * *